United States Patent [19]

Ku

[11] Patent Number: 4,862,224

[45] Date of Patent: Aug. 29, 1989

[54] CLEANING DEVICE FOR ELECTROSTATIC IMAGING APPARATUS

[75] Inventor: Wayne W. Ku, Henrietta, N.Y.

[73] Assignee: Eastman Kodak Company, Rochester, N.Y.

[21] Appl. No.: 177,292

[22] Filed: Apr. 4, 1988

[51] Int. Cl.[4] ..... G03G 21/00

[52] U.S. Cl. ..... 355/200; 355/271; 15/15 R; 15/256.52

[58] Field of Search ..... 355/15, 3 TR, 4; 430/125, 126; 15/1.5 R, 256.51, 256.52

[56] References Cited

U.S. PATENT DOCUMENTS

| | | | |
|---|---|---|---|
| 4,081,212 | 3/1978 | Wetzer | 355/3 TR |
| 4,101,215 | 7/1978 | Fottner et al. | 355/15 |
| 4,183,655 | 1/1980 | Umahashi et al. | 355/3 TR |
| 4,530,596 | 7/1985 | Kawamoto et al. | 355/15 |
| 4,588,279 | 5/1986 | Fukuchi et al. | 355/15 X |

*Primary Examiner*—Arthur T. Grimley
*Assistant Examiner*—J. Pendegrass
*Attorney, Agent, or Firm*—Leonard W. Treash

[57] ABSTRACT

A cleaning device for electrostatic imaging apparatus is movable between a position engaging a transfer drum and a position out of such engagement. The device has a biased roller of a soft conductive silicone rubber which is rolled by the drum surface. A bias on the roller attracts toner from the drum to the roller and a blade scrapes it into a toner collection chamber. Adjustment of the bias on the drum is accomplished in response to movement of the cleaning drive. The device is readily removable and is of such simple construction it can be economically disposable.

16 Claims, 5 Drawing Sheets

CLEANING DEVICE FOR ELECTROSTATIC IMAGING APPARATUS

TECHNICAL FIELD

This invention relates to electrostatic imaging, for example, electrophotography, and more specifically, to a device for cleaning a transfer drum of such apparatus.

BACKGROUND ART

Cleaning devices for transfer drums in electrophotographic or other electrostatic apparatus are well known. For example, color copiers presently available attach a sheet of paper to a transfer drum. The drum is rotated a plurality of times bringing a transfer surface of the sheet into transfer relationship with an electrophotographic imaging member. With each presentation of the transfer surface to the imaging member a different colored toner image is transferred to the transfer surface, generally under the urging of an electric field. Several color images are superposed in this manner forming a multicolor image on the transfer surface.

Inevitably toner and paper fibers get on the external cylindrical surface of the transfer drum itself where they then transfer to the rear of the next transfer sheet. Fur brush cleaners and web cleaners have been used commercially to clean the external cylindrical surface of transfer drums in such apparatus; see, for example, U.S. Pat. No. 3,819,263. Such cleaning devices are articulated from a position out of contact with the drum, when the apparatus is in a transfer mode, to a position in cleaning engagement with the drums, when the apparatus is in a cleaning mode. Fur brushes generally require vacuum or other fairly complex mechanism to get rid of the toner and also must be driven by a motor. Web cleaners are less expensive but the web itself must be indexed and the web must be changed periodically.

Transfer drums are also known which receive toner images directly to their external cylindrical surface without the interposition of a transfer sheet. In color apparatus, these drums receive more than one image in registration to their surface forming a multicolor image on the drum surface. The multicolor image is transferred to a transfer sheet either in the same nip as the original toner images were transferred or at a location remote from the original nip. Because of incomplete transfer to the transfer sheet the external cylindrical surface of these drums generally must be cleaned between formation of each multicolor image.

Roller cleaners have been used commercially to clean electrophotographic drums; see for example, U.S. Pat. Nos. 3,655,373; 3,807,853; 3,838,472; 4,101,215; and 4,530,596. In its simpliest form, a soft conductive rubber roller is allowed to roll with the drum, a bias is applied to the roller to attract the toner to it from the drum, and the softness of the rubber roller compared to the surface of the drum cooperates with that bias to clean the drum. The roller itself passes into contact with a scraping blade which scrapes the toner into a disposing mechanism, for example, an auger or the like.

Cleaning rollers have also been used for transfer drums in monocolor apparatus which rollers do not have to be articulated; see, for example, U.S. Pat. Nos. 4,183,655; 4,439,462; and 4,588,279. In U.S. Pat. No. 4,183,655 the toner is removed from a transfer drum to a roller under a first electrical field and then transferred back to the drum under an opposite direction electrical field for eventual transfer to the photoconductor and removal by the primary cleaning station. In this device, the roller does not actually engage the drum, but cleans across a small air gap.

A problem which must be overcome in cleaning transfer drums is that the drum is generally electrically biased to a high potential relative to the imaging member backing (usually ground) to attract toner in the transfer mode. If a similarly strong field is to be employed to move the same toner to a cleaning roller, a very high bias must be applied to the roller or expensive high voltage switching applied to the drum.

DISCLOSURE OF THE INVENTION

It is an object of this invention to provide electrostatic imaging apparatus generally of the type having a cleaning device which is articulated into cleaning relation with an external cylindrical surface of a transfer drum when said apparatus is in a cleaning mode and out of such cleaning relation when in a transfer mode, which cleaning device solves the latter mentioned bias problem and is simple in construction and economical to manufacture.

This and other objects are accomplished by providing means for applying an electrical bias to the cleaning means of a potential urging toner from the external cylindrical surface to the cleaning means with respect to the potential of the drum when in a cleaning mode. Because the drum is adapted to be biased to a potential attracting toner from an imaging member when in a transfer mode, means are provided for changing the potential of the transfer drum when the cleaning means is in cleaning relation to the drum from its potential when the apparatus is operating in its transfer mode in response to movement of the cleaning means into and out of cleaning relation with the drum.

It is also an object of the invention to provide a cleaning device for a transfer drum which is of such simple construction that it can be disposable.

This and other objects are accomplished by providing a cleaning device for cleaning the surface of the transfer drum in an electrostatic apparatus which includes a housing shaped to provide a chamber to collect toner, a roller journaled for rotation in the housing and having a soft surface for cleaning toner from a transfer drum, a scraper blade positioned to contact the roller for removing toner therefrom and depositing toner so removed in said chamber and a pivot means axially aligned on opposite walls of the housing to engage complementary structure on a receiving apparatus to support the housing for pivotal movement about an axis parallel to the roller.

With such a simple construction the device can be mounted in the apparatus using the same means that is used to pivot it into engagement with the drum for cleaning. A device of such simple construction can be made so inexpensively it can be disposed of and replaced by a serviceman when full of toner.

BRIEF DESCRIPTION OF THE DRAWINGS

In the detailed description of the preferred embodiment of the invention presented below reference is made to the accompanying drawings, in which.

BEST MODE OF CARRYING OUT THE INVENTION

Figure 1:
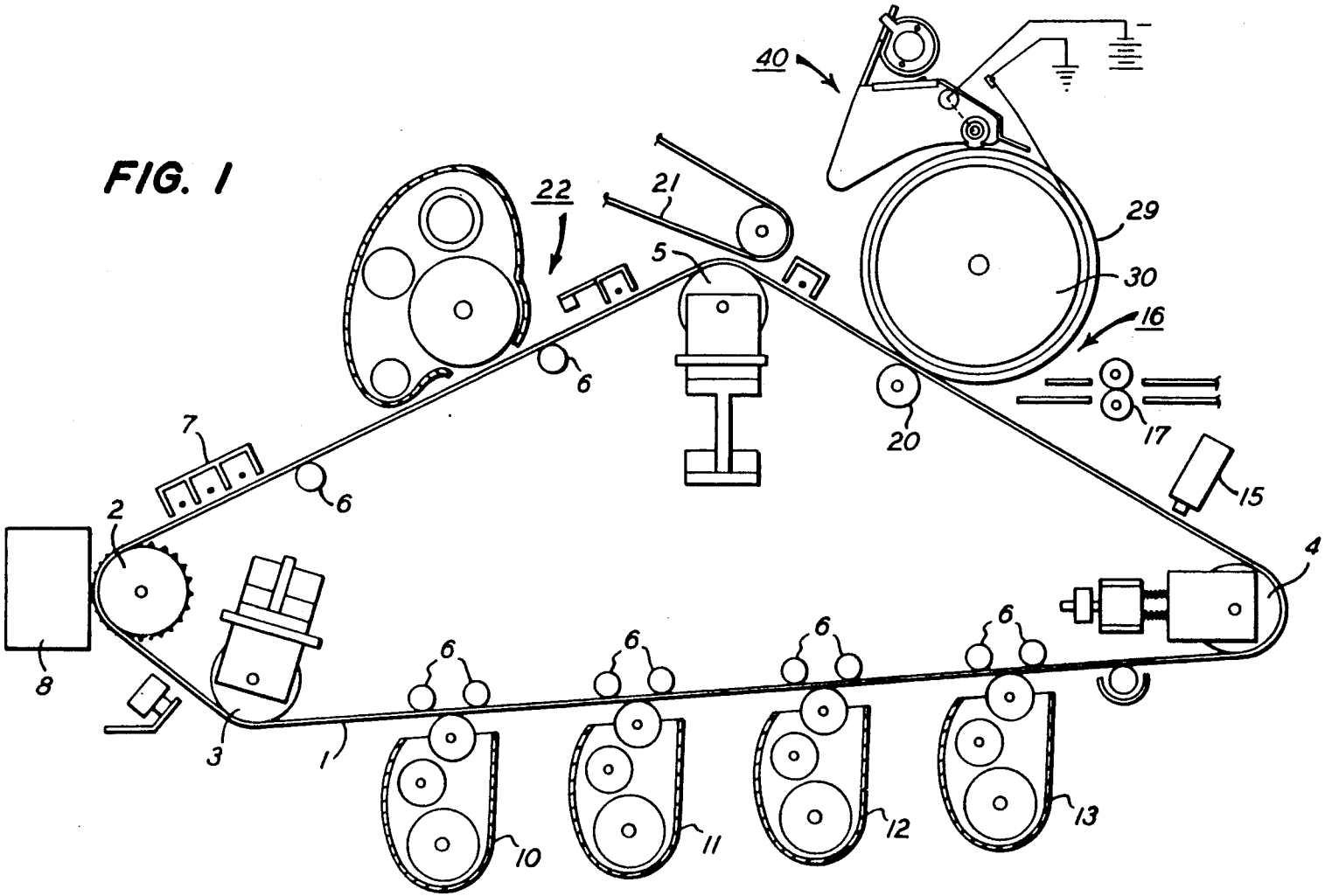
FIG. 1 is a schematic side view of an electrostatic imaging apparatus incorporating the invention.

According to FIG. 1, an electrostatic imaging apparatus includes an imaging member, for example, an electrophotosensitive endless web 1 mounted on a series of rollers 2, 3, 4 and 5 and partially supported by film skis 6. According to conventional technology, imaging member 1 is uniformly charged at a charging station 7 exposed at an electronic exposure station 8 to create an electrostatic image, developed at one of toning stations 10, 11, 12 and 13 to form an electrostatically held toner image. The toner image is transferred at a transfer station 16 to a transfer surface. Residual toner is cleaned from the web 1 at a cleaning station 22 and the imaging member 1 is reused.

The electrostatic imaging apparatus shown in FIG. 1 is adapted to make multicolor reproductions for which this invention is particularly suited. As is well known in the art, these multicolor reproductions are made by superimposing consecutive differently colored images carried by image member 1 on the transfer surface at transfer station 16. More specifically, consecutive cyan, magenta, yellow and black images are formed on imaging member 1 corresponding to different components of a proposed multicolored image. In one embodiment, as the images approach the transfer station 16 a transfer sheet is fed by sheet handling apparatus 17 into engagement with an external cylindrical surface 29 of a transfer drum 30. The transfer sheet is held to the drum by suitable means, for example, small gripping fingers or vacuum vents, not shown, see for example, U.S. Pat. No. 4,712,906, Bothner et al. As transfer drum 30 is rotated in a clockwise direction, it brings the transfer surface of the transfer sheet into transfer relation two, three or four separate times with imaging member 1, forming a two, three or four color image on the transfer surface. The transfer sheet is separated from the external cylindrical surface 29 by elimination of the gripping mechanism, for example, by reduction in the vacuum holding force, or by a more positive stripping mechanism, not shown. The transfer sheet then continues with the imaging member to a separation position associated with roller 5 where it is picked up by a paper transport mechanism 21 and transported to a fuser and an output tray, not shown, and all as well-known in the art.

Alternatively the 4-color toner images can be transferred in registration directly to the external cylindrical surface 39 of transfer drum 30 and then the resulting multicolor image transferred to a surface of a transfer sheet. In this embodiment the transfer sheet can still be fed by sheet handling mechanism 17 into the transfer nip after the multicolor image is formed on the external cylindrical surface 29. The transfer to the receiving sheet can also be performed at a position on the external cylindrical surface 29 that is remote from the original transfer site.

In both of these embodiments, transfer is effected, as is well known in the art, in the presence of an electrical field which urges the toner from the imaging member to the transfer surface. For example, using an imaging member 1 having a conductive backing that is grounded, initial electrostatic charge is placed on that member at the charging station 7 of positive 700 volts. After discharge by exposing station 8 to a minimal voltage of say positive 100 volts, the discharged areas are toned by the application of toner carrying a positive charge, which toner adheres to the exposed, discharged portions. At the transfer station a bias of a negative potential, for example negative 2000 volts, is placed on the drum 30 relative to a grounded conductive backing on imaging member 1. Alternatively, the potential of the imaging member 1 can be controlled by applying a ground bias to a back-up roller 20.

In both embodiments discussed above, the external cylindrical surface 29 of the transfer drum 30 picks up substantial amounts of toner and also dust and paper fiber. In the embodiment in which the toner images are transferred directly to the external cylindrical surface 29 residual toner must be cleaned off after transfer of each multicolor image. In the embodiment in which toner is transferred directly to the transfer surface of a receiving sheet to form the multicolor image directly on the receiving sheet, the external cylindrical surface 29 must be cleaned from time to time. Obviously, the cleaning device cannot engage the external cylindrical surface while images are being transferred. Accordingly, cleaning devices constructed according to prior art have been mounted for pivotal, articulating movement in and out of engagement with the external cylindrical surface 29. Such structures in the prior art have been complex and expensive. In some instances, they wear the transfer drum surface.

Additionally, such cleaning devices have faced the problem of removing toner held to a surface to which that toner is attracted by a relatively high potential, in the example given above, negative 2000 volts with respect to the imaging member.

According to the invention, a cleaning device 40 is so simple in construction that it may be disposed of when full of toner. In inflicts negligible wear to the transfer drum surface, and it provides a low cost solution to the problem of cleaning a high potential transfer roller.

Referring to FIGS. 2–5, cleaning device 40 includes a housing 41 shaped to provide a chamber 42 to collect toner. The housing is preferably molded in one piece out of a suitable plastic. The housing contains an elongated portion 42 supporting end walls 44 and 45 (see FIG. 5). Chamber 42 is closed by a thin metallic cover 50 which slides into place. A cleaning roller 51 is journaled for rotation in metallic mounts in openings in end walls 44 and 45. Roller 51 should be made of a conductive material which is softer than the cylindrical surface 29 to be cleaned. For example, it can be made of a conductive silicone rubber having a surface resistivity of $10^4$ohm-cm and a softness of 30 shore A, when cleaning an external cylindrical surface of polyurethane having a surface conductivity of $10^{11}$ohm-cm and a softness of 55 shore A. Such rollers inflict negligible damage to the drum surface.

Figure 4:
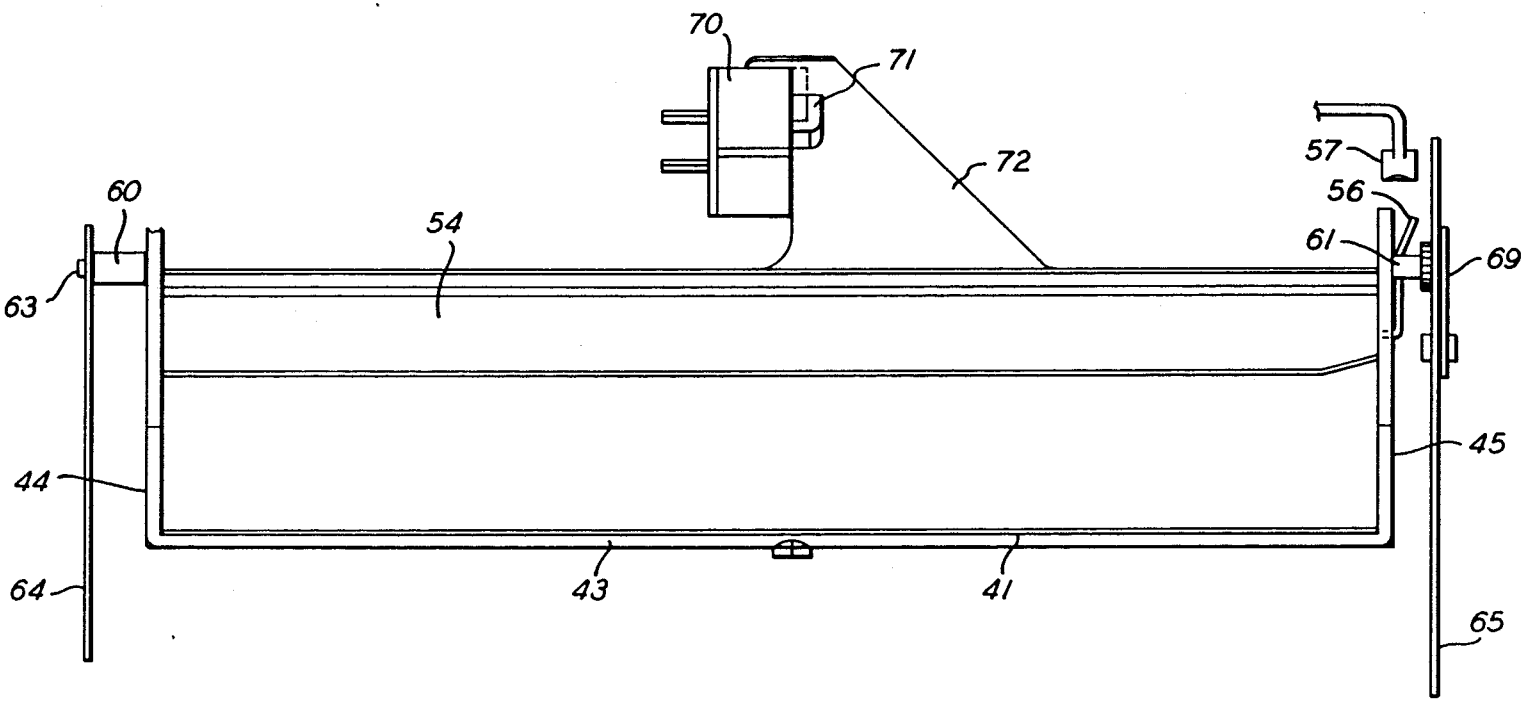
FIG. 4 is a front view of the device shown in FIGS. 2 and 3 with portions eliminated for clarity.
Figure 5:
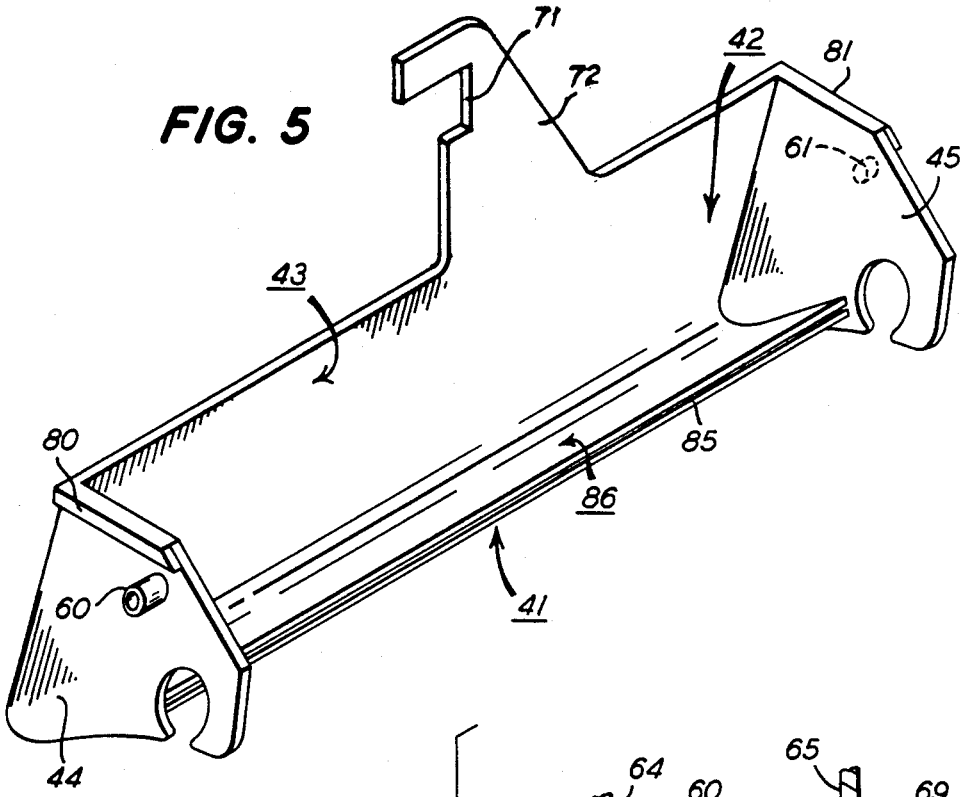
FIG. 5 is a perspective view of a one-piece moldable housing of the cleaning device shown in FIGS. 2–4.
Figure 6:
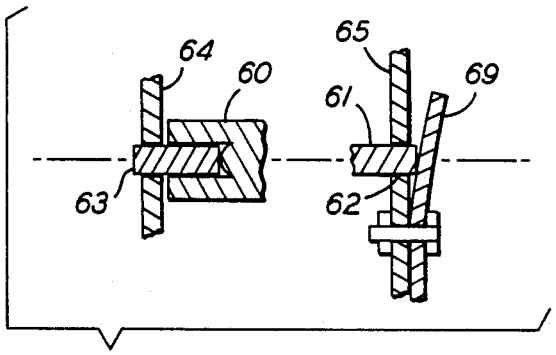
FIG. 6 is a cross-section of a pivot and mounting portion of the cleaning device and its receiving apparatus.

Referring to FIGS. 4 and 6 the cleaning device is coupled to the imaging apparatus by providing cylindrical molded plastic protrusions 60 and 61 in ends 44 and 45, respectively. Protrusion 61 fits in an aperture 62 in receiving plate 65. As seen in FIG. 6 protrusion 60 is hollow and receives a protrusion 63 which is a permanent part of a receiving plate 64. The bearing surface inside protrusion 60 has a convex surface to better support pivotal movement on protrusion 63. Installation is accomplished by inserting protrusion 61 in aperture 62 against the urging of a leaf spring 69 until protrusion 60 can be fit over protrusion 63. Leaf spring 69 then holds the device between the two receiving plates. Thus the device is simply inserted (as simple as a toilet paper spindle) and is supported by the same simple mechanism upon which it pivots for its articulation.

Articulation itself is accomplished by a rotary solenoid 70 mounted as a permanent part of the electrostatic imaging apparatus. Rotary solenoid 70 engages the edges of a recess 71 in an integral extension 72 of housing 41. When rotary solenoid 70 is actuated in a clockwise direction (FIG. 2), housing 41 is rotated in a clockwise direction around protrusions 60 and 61 bringing cleaning roller 51 into engagement with external cylindrical surface 29. Roller 51 is not separately driven but rolls on the surface of cylindrical surface 29 to clean toner therefrom. Toner cleaned off the surface of roller 29 is scraped from the surface of roller 51 by a scraping blade 55, and toner so scraped falls into chamber 42 where it collects. When rotary solenoid 70 is rotated in a counterclockwise direction the opposite edge of recess 71 is engaged and the housing 41 is rotated about protrusions 60 and 61 in a counterclockwise direction to remove roller 51 from engagement with external cylindrical surface 29, thereby permitting the imaging apparatus to operate in its transfer mode.

Figure 2:
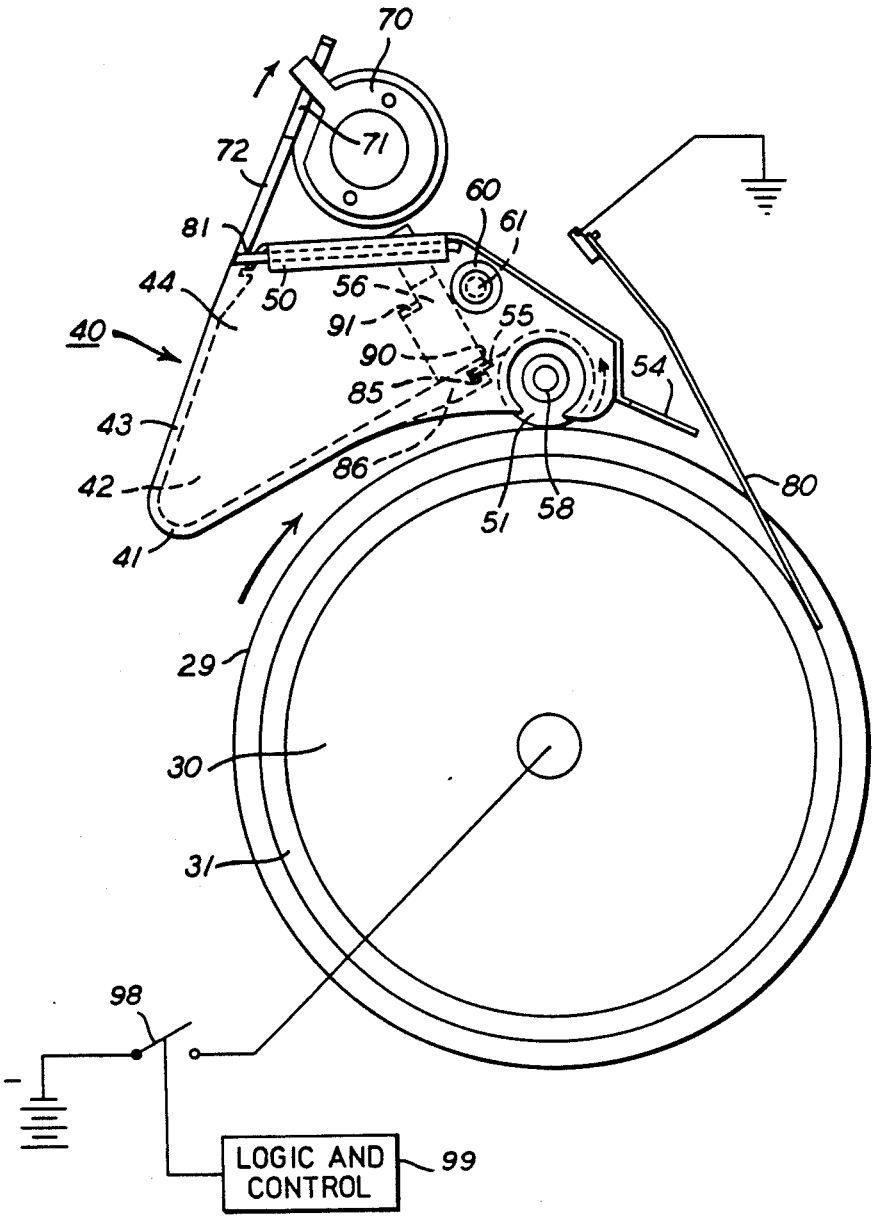
FIGS. 2 and 3 are side schematic cross-sections of a cleaning device constructed according to the invention, with portions eliminated for clarity, showing the device in its two operating positions, respectively.
Figure 7:
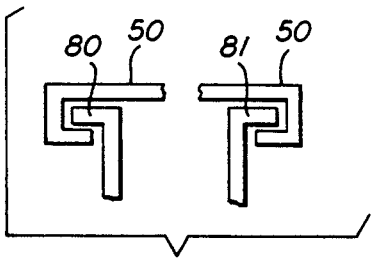
FIG. 7 is a cross-section of a cover and housing mounting structure of the cleaning device.

According to FIGS. 2 and 7, the metallic cover 50 is attached to the housing 41 by sliding it from the right (as seen in FIG. 2) to left over molded rails 80 and 81 in ends 44 and 45, respectively.

Figure 8:
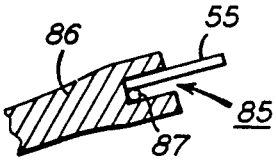
FIG. 8 is a cross-section of a scraper blade mounting structure in the cleaning device.

According to FIGS. 2 and 8 scraping blade 55 is positioned in an end slot 85 in molded extension 86 of the bottom wall to chamber 42. It is held in the slot by a long resilient band 87 forced between blade 55 and the bottom wall of the slot (see FIG. 8).

To attract toner to cleaning roller 51 a bias, for example, of −2000 volts is applied to roller 51 through electrical connector 56 which is plugged into electrical lead 57 shown unplugged in FIG. 4 for clarity of illustration. Connector 56 is a thin metallic plate (shown in FIGS. 2 and 4) having right angle mounting tabs 90 and 91 which fit in complementary slots in end 45 to secure the connector 56 to end 45. Mounting tab 90 is long enough to go into the end of end slot 85 where it engages scraping blade 55, and two metallic elements 55 and 56 being held together by the confines of the slots, band 86 and their own resilience.

The voltage bias is thus applied from receiving apparatus electrical lead 57, through connector 56 and scraping blade 55 to the surface of cleaning roller 51.

When the device is in the cleaning mode, transfer drum 30 must be biased to a potential which in combination with the potential on roller 51, provides a field urging toner from external cylindrical surface 29 to the roller 51. To provide that potential on the drum 30 a leaf spring electrical connector 80 is mounted to a portion of the frame of the imaging apparatus which is grounded. When the cleaning device is in its cleaning mode, spring 80 rides in contact with a metallic core 31 which is exposed at the edge of drum 30 as shown in FIG. 2. When the imaging apparatus is in its transfer mode (FIG. 3), rotary solenoid 70 has rotated housing 41 to a position moving roller 51 out of engagement with external cylindrical surface 29. An extension 54 of metallic cover 50 engages spring 80 to move spring 80 out of contact with metallic core 31 so that the apparatus can operate in the transfer mode.

Figure 3:
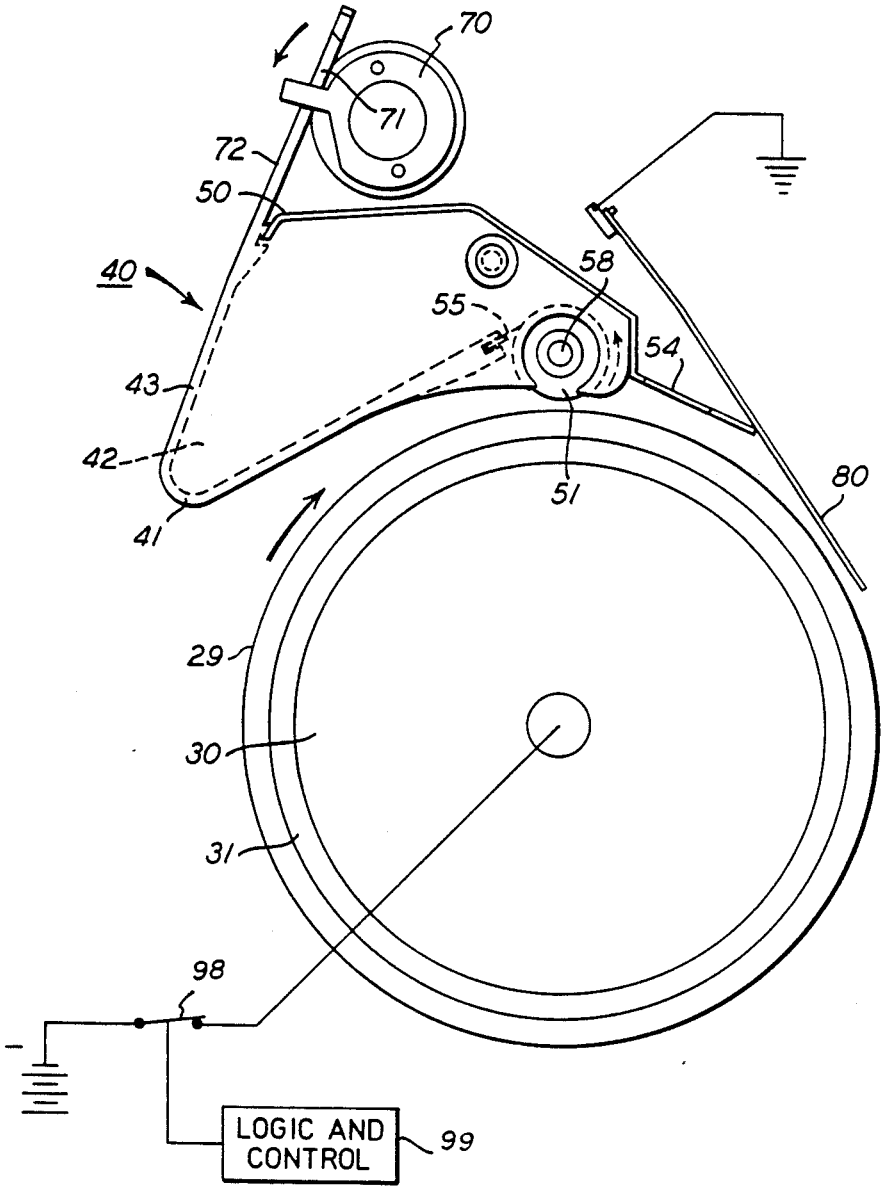

In the transfer mode, the bias for the transfer drum is applied directly through the mounting structure for the drum, as is well known in the art. A switch 98 shown schematically in FIG. 2 and 3 is closed automatically by a logic and control 99 for the apparatus. Alternatively switch 98 could be located in a manner to be also closed in response to rotation of housing 41 much in the same way that spring 80 is removed from contact with the exposed portion of metallic core 31.

Switch 98 could also apply the ground to the drum for the cleaning mode but this approach has the disadvantage of requiring multiple potentials for the same power source and an expensive high voltage switch.

The invention has been described in detail with particular reference to a preferred embodiment thereof, but it will be understood that variations and modifications can be effected within the spirit and scope of the invention as described hereinabove and as defined in the appended claims.

I claim:

1. Electrostatic imaging apparatus comprising:

a transfer drum having an external cylindrical surface;

means for applying an electrical bias of a first potential to said transfer drum to urge toner to transfer from an imaging member to a transfer surface associated with said drum, said transfer surface either being the cylindrical surface of the drum itself or the surface of a transfer sheet carried by the cylindrical surface of the drum;

means for cleaning the cylindrical surface of said drum, said cleaning means being moveable from a first position out of cleaning relation with said cylindrical surface to a second position in cleaning relation with said cylindrical surface;

means moveable into engagement with said drum for applying to said drum a bias of a second potential different from said first potential, and means for applying an electrical bias to said cleaning means having a third potential urging toner from said cylindrical surface to the cleaning means with respect to said second potential associated with said drum; and means for controlling the engagement of said second potential applying means with said drum in response to movement of said cleaning means from its second position to its first position.

2. Electrostatic imaging apparatus according to claim 1 wherein said second potential is ground and said first and third potentials are of the same polarity.

3. Electrostatic imaging apparatus according to claim 1 wherein said means for applying said bias of a second potential to said drum is an elongated resilient metallic member normally contacting said drum and said controlling means is a projection on said cleaning means positioned to engage said member to move it out of contact with said drum when said cleaning means moves from its second position to its first position.

4. Electrostatic imaging apparatus according to claim 1 wherein said cleaning means is a disposable cleaning device having:

a one-piece molded housing shaped to provide a chamber to permanently collect toner removed from said cylindrical surface;

a roller journaled for rotation in said housing and having a soft surface for cleaning toner from said cylindrical surface; and a scraper blade contacting said roller for removing toner therefrom.

5. An electrostatic imaging apparatus according to claim 4 wherein said cleaning means further includes pivot means axially aligned and molded in opposite end walls of the housing to engage complementary structure on said electrostatic imaging apparatus to removeably pivotally support said housing, said housing being pivotable about an axis through said pivot means.

6. Electrostatic imaging apparatus according to claim 5 further including means for engaging said cleaning means to rotate said cleaning means about said pivot means thereby moving said roller into and out of rolling and cleaning engagement with said cylindrical surface.

7. An electrostatic imaging apparatus according to claim 6 wherein said engaging means is a cylindrical solenoid.

8. Electrostatic imaging apparatus according to claim 1 wherein said cleaning means includes a soft roller journaled for rotation by frictional engagement with said transfer drum when in cleaning engagement therewith.

9. A disposable cleaning device for cleaning a surface in an electrostatic apparatus, comprising:

a one-piece molded housing shaped to provide a chamber to permanently collect toner;

a cleaning roller journaled for rotation in said housing and having a soft surface for cleaning toner from a transfer drum;

a scraper blade positioned to contact said roller for removing toner therefrom and for depositing it in said chamber; and pivot means axially aligned and molded into opposite walls of the housing to engage complementary structure on a receiving apparatus to support said housing for pivotal movement about an axis parallel with said roller.

10. A disposable cleaning device according to claim 9 which device is adapted to be received in an apparatus having an actuating means, said disposable cleaning device including means engageable by said actuating means to pivot said housing about said pivot means to change the location of said roller.

11. Disposable cleaning device according to claim 10 further including a projection moveable with said housing in response to pivoting movement of said housing for controlling the position of an electrical potential applying means for applying a potential to a transfer drum being cleaned.

12. A disposable cleaning device according to claim 9 wherein said pivot means include axially aligned cylindrical protrusions receivable in and rotatable with respect to apertures in a receiving apparatus.

13. A disposable cleaning device according to claim 9 including a flat metallic contacting element having a free end and at least two bent tabs mounting said element to an external surface of an end wall of said housing, one of said tabs extending through said end wall into contact with said scraper blade, the free end being engageable by a bias applying contact in a receiving apparatus to apply a bias through the element and scraper blade to the cleaning roller surface.

14. A disposable cleaning device according to claim 9 wherein said housing includes an elongated slot in the end of a bottom wall for receiving said scraper blade.

15. A disposable cleaning device according to claim 14 wherein said scraper blade is held in said slot by an elongated resilient band positioned between said blade and one of the interior walls of said slot.

16. Electrostatic imaging apparatus comprising:

a transfer drum having an external cylindrical surface;

means for applying an electrical bias of a first potential to said transfer drum to urge toner to transfer from an imaging member to a transfer surface associated with said drum, said transfer surface either being the cylindrical surface of the drum itself or the surface of a transfer sheet carried by the cylindrical surface of the drum;

means for cleaning the cylindrical surface of said drum;

means for applying to said drum a bias of a second potential different from said first potential; and means for applying an electrical bias to said cleaning means having a third potential urging toner from said cylindrical surface to the cleaning means with respect to said second potential associated with said drum;

said apparatus having two modes of operation, a transfer mode in which said first potential is applied to said drum and a cleaning mode in which said second potential is applied to said drum.

* * * * *